US007614251B2

(12) United States Patent
Choi et al.

(10) Patent No.: US 7,614,251 B2
(45) Date of Patent: Nov. 10, 2009

(54) RECIPROCATING COMPRESSOR AND REFRIGERATOR HAVING THE SAME

(75) Inventors: Ki-Chul Choi, Seoul (KR); Kyeong-Bae Park, Seoul (KR); Eon-Pyo Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 392 days.

(21) Appl. No.: 11/242,947

(22) Filed: Oct. 5, 2005

(65) Prior Publication Data

US 2006/0171825 A1 Aug. 3, 2006

(30) Foreign Application Priority Data

Feb. 3, 2005 (KR) ..... 10-2005-0010166

(51) Int. Cl.
*F25B 1/10* (2006.01)

(52) U.S. Cl. ..... 62/510; 417/417; 417/523

(58) Field of Classification Search ..... 62/510; 417/45, 415, 416, 417, 259, 545, 453; 310/12, 310/13, 14, 15
See application file for complete search history.

(56) References Cited

U.S. PATENT DOCUMENTS

| | | | | |
|---|---|---|---|---|
| 4,761,118 | A * | 8/1988 | Zanarini | 417/254 |
| 4,965,864 | A * | 10/1990 | Roth et al. | 318/135 |
| 5,046,325 | A * | 9/1991 | Kuwahara | 62/156 |
| 5,577,390 | A * | 11/1996 | Kaido et al. | 62/228.5 |
| 6,015,270 | A * | 1/2000 | Roth | 417/259 |
| 7,061,145 | B2 * | 6/2006 | Heo | 310/15 |
| 7,105,957 | B2 * | 9/2006 | Lee | 310/14 |
| 7,150,605 | B2 | 12/2006 | Kim et al. | |
| 2004/0247466 | A1 | 12/2004 | Lee et al. | |
| 2005/0139428 | A1 * | 6/2005 | Hyun et al. | 184/6.16 |
| 2006/0093496 | A1 * | 5/2006 | Lee et al. | 417/417 |

FOREIGN PATENT DOCUMENTS

| | | |
|---|---|---|
| CN | 1480647 | 3/2004 |
| CN | 1573109 | 2/2005 |
| FR | 2327423 | 5/1977 |
| JP | 2003-083247 | 3/2003 |

* cited by examiner

*Primary Examiner*—Mohammad M Ali
(74) *Attorney, Agent, or Firm*—Ked & Associates, LLP

(57) ABSTRACT

Disclosed are a reciprocating compressor and a refrigerator having the same. The reciprocating compressor comprises a casing, one reciprocating motor mounted at a frame unit provided in the casing for generating a linear-reciprocation driving force, a first compression unit for compressing a refrigerant directly sucked without passing through the inside of the casing by receiving the driving force of the reciprocating motor, and a second compression unit for mixing a refrigerant introduced into the casing and a refrigerant discharged from the first compression unit and then compressing the mixed refrigerant once more by receiving the driving force of the reciprocating motor. Accordingly, a refrigerant is consecutively compressed two times, components are simplified, and the compressor is easily controlled. Also, the refrigerator having the reciprocating compressor decreases a load of the reciprocating compressor thereby to enhance the efficiency of the refrigerator.

15 Claims, 7 Drawing Sheets

RECIPROCATING COMPRESSOR AND REFRIGERATOR HAVING THE SAME

The present disclosure relates to subject matter contained in priority Korean Application No. 10166/2005, filed on Feb. 3, 2005, the disclosure of which is herein expressly incorporated by reference in its entirety.

BACKGROUND OF THE INVENTION

1. Field of the Invention

The present invention relates to a reciprocating compressor and a refrigerator having the same, and more particularly, to a reciprocating compressor capable of simplifying components by two-stage compressing a refrigerant by using one reciprocating motor, capable of being easily controlled, and capable of compressing a refrigerant with a high pressure ratio and a decreased load, and a refrigerator having the same.

2. Description of the Conventional Art

Generally, a compressor is a device for compressing a refrigerant by converting electric energy into mechanical energy. The compressor is part of a refrigerating cycle system, and the refrigerating system is utilized in a refrigerator, an air conditioner, a show case, etc.

The compressor is classified as a rotary compressor, a reciprocating compressor, a scroll compressor, etc. according to a mechanism for compressing a refrigerant. As a compressor that is part of the refrigerating cycle system mounted in a refrigerator, a reciprocating compressor is mainly used.

It is possible that the refrigerator is provided with one evaporator and cool air generated from the evaporator is circulated into a freezing chamber and a refrigerating chamber. It is also possible that the refrigerator is provided with two evaporators and cool air generated from the respective evaporators is respectively circulated into the freezing chamber and the refrigerating chamber. According to the type of the refrigerator, a type of a reciprocating compressor mounted at the refrigerator is varied.

FIG. 1 is a sectional view showing an example of a reciprocating compressor.

As shown, the reciprocating compressor comprises a casing 100 having two suction pipes 101 and 102 and one discharge pipe 103, a frame unit 110 provided with one cylinder hole C1 having a certain inner diameter and mounted in the casing 100, first and second reciprocating motors facing each other at both sides of the frame unit 110 for generating a linear-reciprocation force, a first piston portion 140 inserted into the cylinder hole C1 and connected to a mover 121 of the first reciprocating motor, a second piston portion 150 inserted into the cylinder hole C1 to face the first piston portion and connected to a mover 131 of the second reciprocating motor 130, a first resonant spring unit 160 for elastically supporting the first piston portion 140 and causing a resonant motion, a second resonant spring unit 170 for elastically supporting the second piston portion 150 and causing a resonant motion, suction valves 181 and 182 respectively coupled to ends of the first and second piston portions 140 and 150 for opening and closing a suction flow path formed in the piston, and a discharge valve 183 for opening and closing a discharge channel connected to the discharge pipe 103.

The suction pipes 102 and 103 are symmetrically positioned at both sides of the casing 100.

The discharge pipe 103 is coupled to the frame unit 110 so as to be connected to a compression space P1 formed in the cylinder hole C1 by the first and second piston portions 140 and 150.

The first and second reciprocating motors 120 and 130 are equally (i.e. substantially identically) formed, and comprises inner stators 122 and 132 and outer stators 123 and 133 coupled to the frame unit 110 with a certain there between, and movers 121 and 131 movably coupled between the inner stators 122 and 132 and the outer stators 123 and 133 for transmitting a driving force of the motor to the piston.

The first and second resonant spring units 160 and 170 are equally formed, and comprises spring supporters 161 and 171 coupled to the pistons, and springs 162 and 172 positioned at both sides of the spring supporters 161 and 171.

An operation of the reciprocating compressor will be explained.

When a power is applied to the reciprocating motor, the movers 121 and 131 of the first and second reciprocating motors 120 and 130 are linearly reciprocated in opposite directions and the linear-reciprocation of the movers 121 and 131 are respectively transmitted to the first and second piston portions 140 and 150. Accordingly, the first and second piston portions 140 and 150 are linearly-reciprocated in the cylinder hole C1 in opposite directions. As the result, a refrigerant respectively sucked through the suction pipes 101 and 102 is sucked into the compression space P1 inside the cylinder hole C1 through suction flow paths 141 and 151 formed at the first piston portion 140 and the second piston portion 150, compressed, and discharged.

That is, when the first and second piston portions 140 and 150 move towards the outside the cylinder hole C1, a pressure of the compression space P1 formed by the first and second piston portions 140 and 150 and the cylinder hole C1 is lowered and the suction valves are respectively opened. Then, a refrigerant respectively sucked through the suction pipes 101 and 102 is sucked into the compression space P1 through the suction flow paths 141 and 151 of the first piston portion and the second piston portion.

When the first and second piston portions 140 and 150 move towards an inner side of the cylinder hole C1, the compression space P1 has a varied volume thereby to compress the refrigerant. Also, when the refrigerant has a pressure more than a set pressure, the discharge valve 183 is opened and the compressed refrigerant is discharged.

The reciprocating compressor individually controls two reciprocating motors and controls strokes of the pistons, thereby controlling a compression capacity of the refrigerant. Also, since the reciprocating motors are arranged to face each other, a vibration can be attenuated.

However, since the reciprocating compressor has two reciprocating motors and two components, a fabrication cost of the reciprocating compressor is expensive.

FIG. 2 is a sectional view showing another example of the reciprocating compressor.

As shown, the reciprocating compressor comprises a casing 200 having one suction pipe 201 and two discharge pipes 202 and 203, a frame unit 210 elastically supported in the casing 200, first and second cylinders 220 and 230 fixedly coupled to both sides of the frame unit 210, a reciprocating motor 240 mounted at the frame unit 210 for generating a linear-reciprocation force, a double piston 250 having both sides respectively inserted into the first and second cylinders 220 and 230 and linearly-reciprocated by receiving a driving force of the reciprocating motor 240, suction valves 261 and 262 respectively mounted at both ends of the double piston 250 for opening and closing a suction flow path F1 penetratingly-formed in the double piston 250, discharge covers 263 and 264 for covering the first and second cylinders 220 and 230, discharge valves 265 and 266 inserted into the discharge covers 263 and 264 for opening and closing compression spaces P2 and P3 of the first and second cylinders 220 and 230, and a resonant spring unit 270 for elastically supporting the double piston 250 and causing a resonant motion.

The two discharge pipes 202 and 203 are respectively connected to the discharge covers 263 and 264.

The reciprocating motor 240 comprises an inner stator 241, an outer stator 242 respectively fixedly coupled to the frame unit 210, and a mover 243 positioned between the inner stator 241 and the outer stator 242. The mover 243 is coupled to the double piston 250.

The resonant spring unit 270 comprises a supporter 271 coupled to the double piston 250, and resonant springs 272 positioned at both sides of the spring supporter 271.

Reference numerals 267 and 268 denote valve springs.

An operation of the reciprocating compressor will be explained.

When a power is applied to the reciprocating motor, the mover 243 is linearly reciprocated by the reciprocating motor 240 and the linear-reciprocation of the mover 243 is transmitted to the double piston 250 thereby to linearly-reciprocate the double piston 250. As the double piston 250 is linearly-reciprocated, a compression space P2 of a first cylinder and a compression space P3 of a second cylinder alternately suck a refrigerant, compress and then discharge the refrigerant.

That is, when the double piston 250 moves towards the first cylinder 220, a refrigerant sucked into the first cylinder 220 is compressed. Then, when the refrigerant has a pressure more than a set pressure, the discharge valve 265 blocking the compression space P2 of the first cylinder is opened thereby to discharge the compresses refrigerant. At the same time, the refrigerant is sucked into the compression space P3 of the second cylinder. Also, when the double piston 250 moves towards the second cylinder 230, the refrigerant is sucked into the compression space P3 of the second cylinder 230 is compressed. Then, when the refrigerant has a pressure more than a set pressure, the discharge valve 266 blocking the compression space P3 of the second cylinder is opened thereby to discharge the compresses refrigerant.

The reciprocating compressor is provided with one reciprocating motor 240 thereby to have a cheap fabrication cost. Also, as the refrigerant is compressed by the two cylinders 220 and 230, a compression capacity of the reciprocating compressor is increased. However, when the double piston 250 moves towards one of the first and second cylinders 220 and 230, a collision between components is generated at the side towards which the double piston 250 moves, and a compression is not smoothly performed in the other side. Accordingly, a stroke of the double piston 250 is not easily controlled.

When the reciprocating compressors are mounted in a refrigerator, the reciprocating compressors compress a refrigerant only one time thereby to have a limitation in compressing the refrigerant with a high pressure ratio. Especially, in case of a refrigerator having a freezing chamber side evaporator and a refrigerating chamber side evaporator, a pressure of a refrigerant that has passed through the freezing chamber side evaporator becomes relatively low. When the refrigerant having a low pressure is compressed to have a proper pressure, a load of the compressor is increased thereby to degrade an efficiency of the compressor.

SUMMARY OF THE INVENTION

Therefore, an object of the present invention is to provide a reciprocating compressor capable of simplifying components by two-stage compressing a refrigerant by using one reciprocating motor, capable of being easily controlled, and capable of compressing a refrigerant with a high pressure ratio and a decreased load, and a refrigerator having the same.

To achieve these and other advantages and in accordance with the purpose of the present invention, as embodied and broadly described herein, there is provided a reciprocating compressor comprising: a casing; one reciprocating motor mounted at a frame unit provided in the casing for generating a linear-reciprocation driving force; a first compression unit for compressing a refrigerant directly sucked without passing through the inside of the casing by receiving the driving force of the reciprocating motor; and a second compression unit for mixing a refrigerant introduced into the casing and a refrigerant discharged from the first compression unit and then compressing the refrigerant once more by receiving the driving force of the reciprocating motor.

According to another embodiment, the reciprocating compressor comprises: a casing; one reciprocating motor mounted at a frame unit provided in the casing for generating a linear-reciprocation driving force; a first compression unit for one-stage compressing a refrigerant directly sucked without passing through the inside of the casing by receiving the driving force of the reciprocating motor; and a second compression unit for two-stage compressing the refrigerant one-stage compressed by the first compression unit.

To achieve these and other advantages and in accordance with the purpose of the present invention, as embodied and broadly described herein, there is also provided a refrigerator having a body provided with a freezing chamber and a refrigerating chamber and having a freezing chamber side evaporator and a refrigerating chamber side evaporator mounted at the body, the refrigerator comprising: a casing mounted at the body; one reciprocating motor mounted at a frame unit provided in the casing for generating a linear-reciprocation driving force; a first compression unit for sucking a refrigerant that has passed through the freezing chamber side evaporator and then compressing the refrigerant by receiving the driving force of the reciprocating motor; and a second compression unit for compressing a mixed refrigerant between a refrigerant introduced into the casing via the refrigerating chamber side evaporator and a refrigerant discharged from the first compression unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The above and other objects, features and advantages of the present invention will be made apparent from the following description of the preferred embodiments, given as non-limiting examples, with reference to the accompanying drawings in which.

DETAILED DESCRIPTION OF THE PREFERRED EMBODIMENTS

Figure 1:
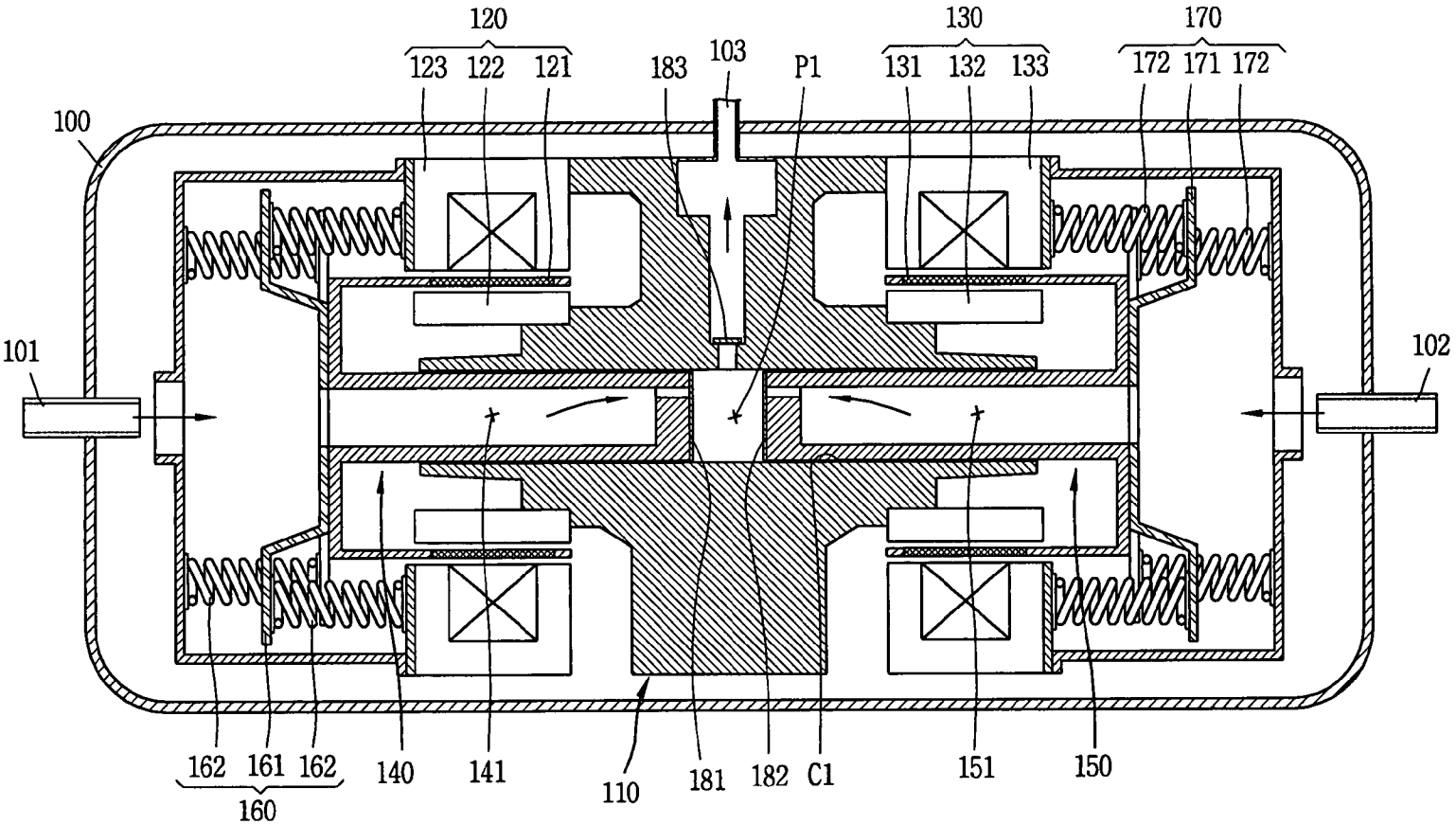
FIG. 1 CONVENTIONAL ART
FIG. 1 is a sectional view showing a reciprocating compressor in accordance with the conventional art.
Figure 2:
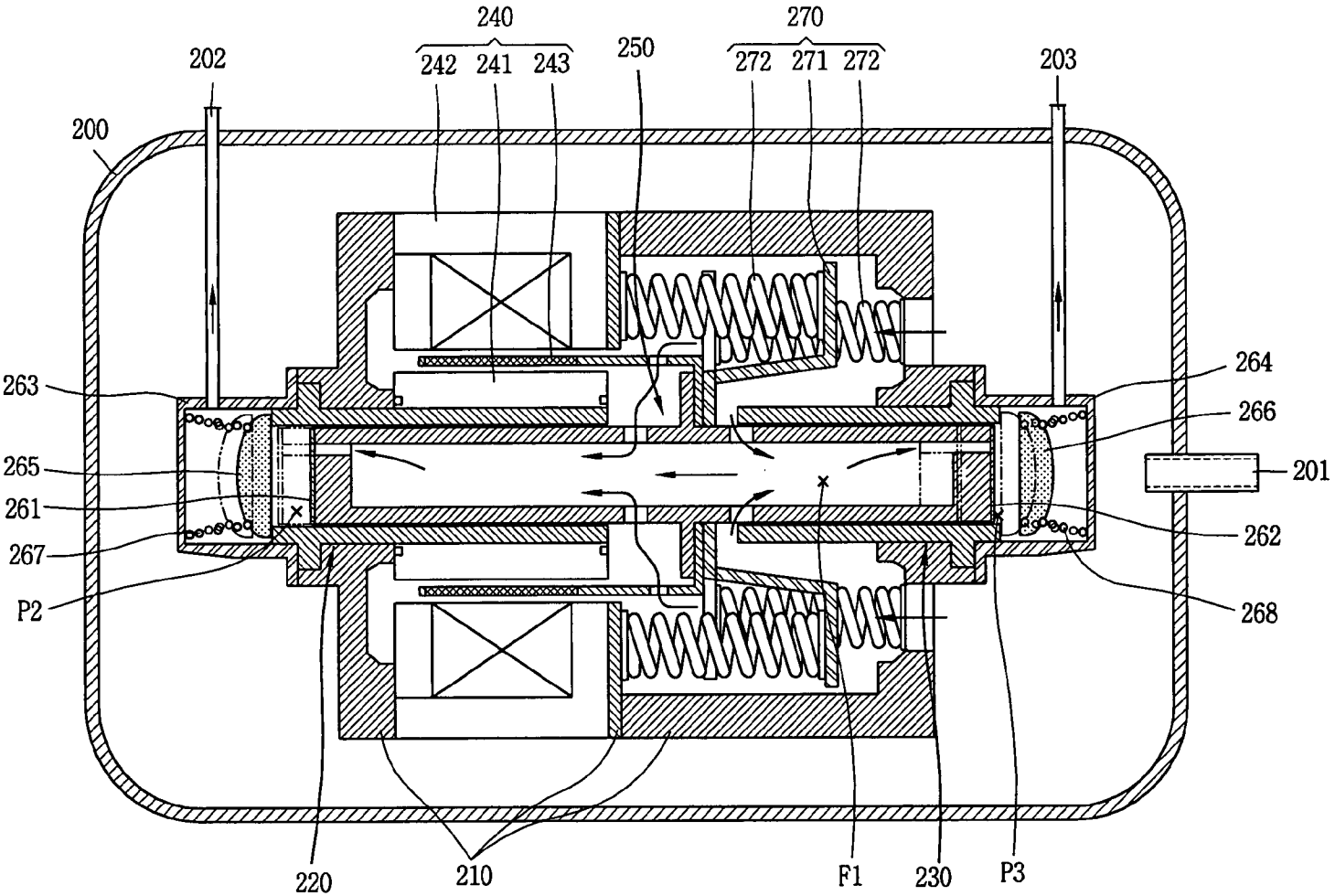
FIG. 2 CONVENTIONAL ART
FIG. 2 is a sectional view showing another embodiment of the reciprocating compressor in accordance with the conventional art.

The present invention is further described in the detailed description which follows, by reference to the noted plurality of drawings by way of non-limiting examples of preferred embodiments of the present invention, in which like reference numerals represent similar parts throughout the several view of the drawings.

Hereinafter, a reciprocating compressor and a refrigerator having the same according to the present invention will be explained in more detail with reference to the attached drawings.

Figure 3:
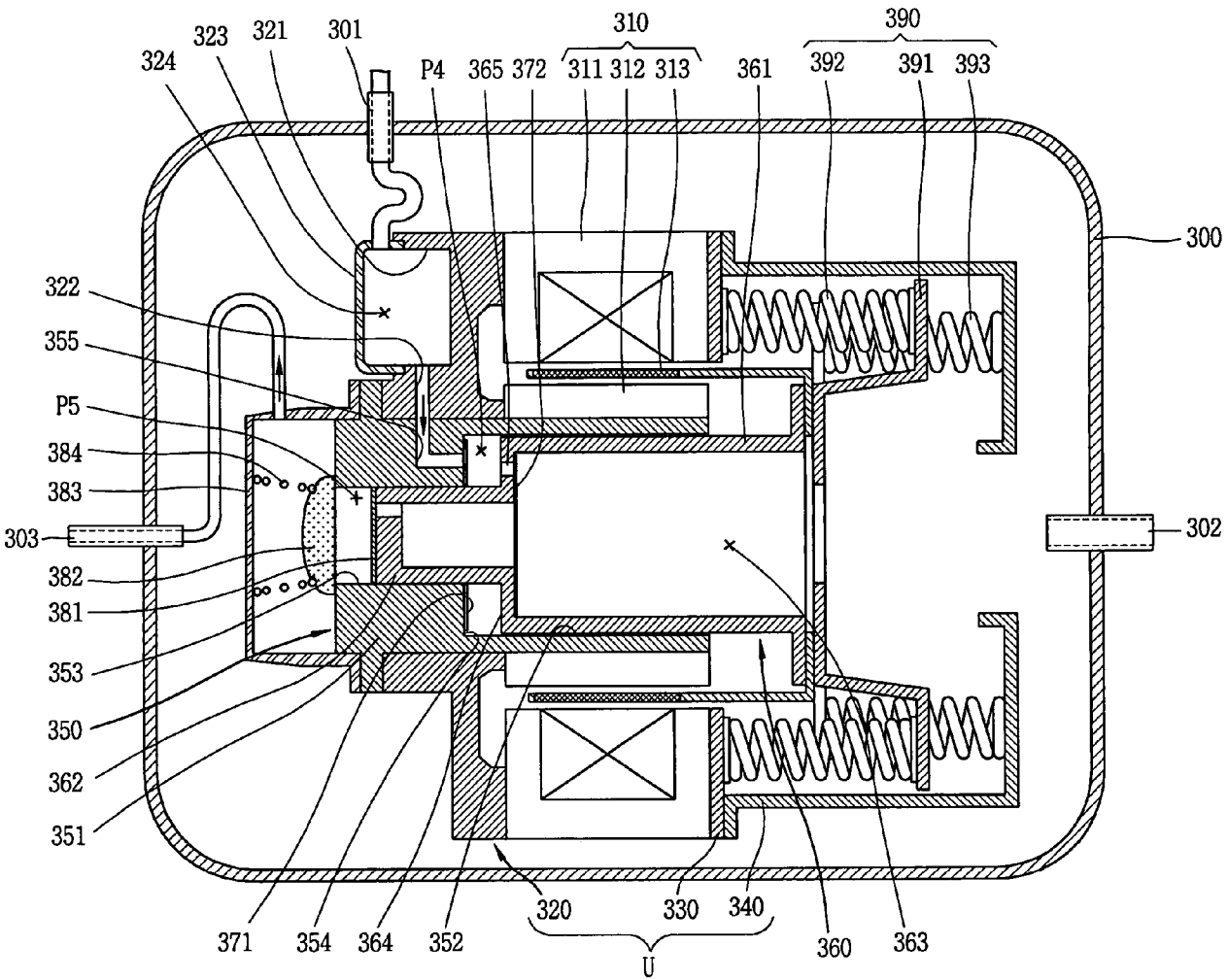
FIG. 3 is a sectional view showing a first embodiment of a reciprocating compressor according to the present invention.

FIG. 3 is a sectional view showing a first embodiment of a reciprocating compressor according to the present invention.

As shown, the reciprocating compressor comprises a casing 300, a frame unit U elastically supported in the casing 300, one reciprocating motor 310 mounted at the frame unit U for generating a linear-reciprocation driving force, a first compression unit for compressing a refrigerant directly sucked without passing through the inside of the casing 300 by receiving the driving force of the reciprocating motor 310, and a second compression unit for mixing a refrigerant introduced into the casing 300 and a refrigerant discharged from the first compression unit and then compressing the refrigerant by receiving the driving force of the reciprocating motor 310.

A first suction pipe 301, a second suction pipe 302, and a discharge pipe 303 are coupled to the casing 300.

The frame unit U comprises a front frame 320 formed to have a certain shape, a middle frame 320 for supporting the reciprocating motor with the front frame 320, and a lower frame 340 connected to the middle frame 330.

A two-stage cylinder 350 is coupled to the front frame 320, and a two-stage piston 360 is linear-movably coupled to inside of the two-stage cylinder 350. The two-stage cylinder 350 comprises a cylinder body 351 having a certain shape, a first cylinder hole or bore 352 having a certain inner diameter and a certain depth in the middle of the cylinder body 351, and a second cylinder hole or bore 353 extending from the first cylinder hole 352 and having an inner diameter smaller than that of the first cylinder hole 352. The first cylinder hole 352 and the second cylinder hole 353 penetrate the center of the cylinder body 351, and an interface between the first cylinder hole 352 and the second cylinder hole 353 forms a stepped surface 354. The stepped surface 354 is perpendicular to center lines of the first and second cylinder holes 352 and 353.

The two-stage piston 360 comprises a first piston portion 361 having an outer diameter corresponding to the inner diameter of the first cylinder hole 352 and a certain length, a second piston portion 362 extending from the first piston portion 361 and having an outer diameter corresponding to the inner diameter of the second cylinder hole 353 and a certain length, and a gas passage 363 penetratingly formed in the first and second piston portions 361 and 362. An interface between the first piston portion 361 and the second piston portion 362 forms a stepped surface 364. The stepped surface 364 is perpendicular to center lines of the first and second piston portions 361 and 362.

A first compression space P4 is formed in the first cylinder hole 352 by the first cylinder hole 352 of the two-stage cylinder 350 and the first piston portion 361 of the two-stage piston 360, and a second compression space P5 is formed in the second cylinder hole 353 by the second cylinder hole 353 of the two-stage cylinder 350 and the second piston portion 362 of the two-stage piston 360.

A first suction flow path connected to the first compression space P4 is formed at the front frame 320 and the two-stage piston 360. The first suction flow path comprises an opening or opening groove 321 formed at one side of the front frame 320, a first suction opening or hole 322 formed at the front frame 320 and connected to the opening groove 321, and a second suction opening hole 355 formed at the two-stage cylinder 350 for connecting the first suction hole 322 and the first compression space P4.

A cover 323 having a certain shape for covering the opening groove 321 is coupled to the front frame 320. The opening groove 321 and the cover 323 form a chamber 324, and a liquid refrigerant introduced through the first suction flow path is vaporized in the chamber 324.

A discharge hole 365 for discharging gas compressed in the first compression space P4 is formed at one side of the two-stage cylinder 350. The discharge hole 365 is penetratingly formed at one side of the stepped surface 364, the interface between the first piston portion 361 and the second piston portion 362. The discharge hole 365 connects the first compression space P4 and the gas passage 363.

A first suction valve 371 for opening and closing the first suction flow path is mounted at the stepped surface 354 of the two-stage cylinder 350, and the first suction valve 371 is positioned in the first compression space P4.

A first discharge valve 372 for opening and closing the discharge hole 365 is mounted at the two-stage piston 360. The first discharge valve 372 is mounted at the stepped surface 364 between the first piston portion 361 and the second piston portion 362 so as to be positioned in the gas passage 363.

A second suction valve 381 for opening and closing the gas passage 363 is mounted at an end surface of the second piston portion 362 of the two-stage piston 360. The second suction vale 381 is positioned in the second compression space P5.

A second discharge valve 382 for opening and closing the second compression space P5 is mounted at an end surface of the two-stage cylinder 350. A discharge cover 383 for covering the second discharge valve 382 is mounted at the two-stage cylinder 350, and a valve spring 384 for elastically supporting the second discharge valve 382 is positioned in the discharge cover 383.

The first suction pipe 301 is fixedly coupled to the casing 300, and one end of the first suction pipe 301 is coupled to the cover 323 constituting the chamber 324 of the first suction flow path so that a refrigerant introduced into the first suction pipe 301 can be directly introduced into the first suction flow path.

The second suction pipe 302 is fixedly coupled to the casing 300, and one end of the second suction pipe 302 is coupled to the casing 300 so that a refrigerant introduced into the second suction pipe 302 can be introduced into the casing 300.

The discharge pipe 303 is fixedly coupled to the casing 300, and one end of the discharge pipe 303 is fixedly coupled to one side of the discharge cover 383 so that the discharge pipe 303 can be connected to inside of the discharge cover 383.

The reciprocating motor 310 comprises an outer stator 311 coupled between the front frame 320 and the middle frame 330, an inner stator 312 inserted into the outer stator 311 with a certain gap and coupled to an outer circumferential surface of the front frame 320 or the two-stage cylinder 360, and a mover 313 linear-movably inserted between the outer stator 311 and the inner stator 312. The mover 313 is connected to the two-stage piston 360 so that the linear-reciprocation driving force of the reciprocating motor 310 can be transmitted to the two-stage piston 360.

A resonant spring unit 390 for causing a resonant motion of the two-stage piston 360 is installed between the middle frame 330 and the rear frame 230. The resonant spring unit 390 comprises a spring supporter 391 coupled to the two-stage piston 360, and resonant springs 392 and 393 positioned at both sides of the spring supporter 391.

The first compression unit comprises the two-stage cylinder 350, the first compression space P4 formed by the two-stage piston 360, the first suction flow path, the first suction valve 371, the first discharge valve 372, the discharge hole 365, etc.

The second compression unit comprises the two-stage cylinder 350, the second compression space P5 formed by the two-stage piston 360, the second suction valve 381, the second discharge valve 382, etc.

An operation of the reciprocating compressor according to the first embodiment of the present invention will be explained.

When a power is applied to the reciprocating motor 310, a flux formed between the outer stator 311 and the inner stator 312 electrically interacts with a flux formed by a magnet provided at the mover 313 and thereby the mover 313 is linearly reciprocated. The linear-reciprocation of the mover 313 is transmitted to the two-stage piston 360, so that the two-stage piston 360 is linearly-reciprocated in the cylinder 350.

Figure 4:
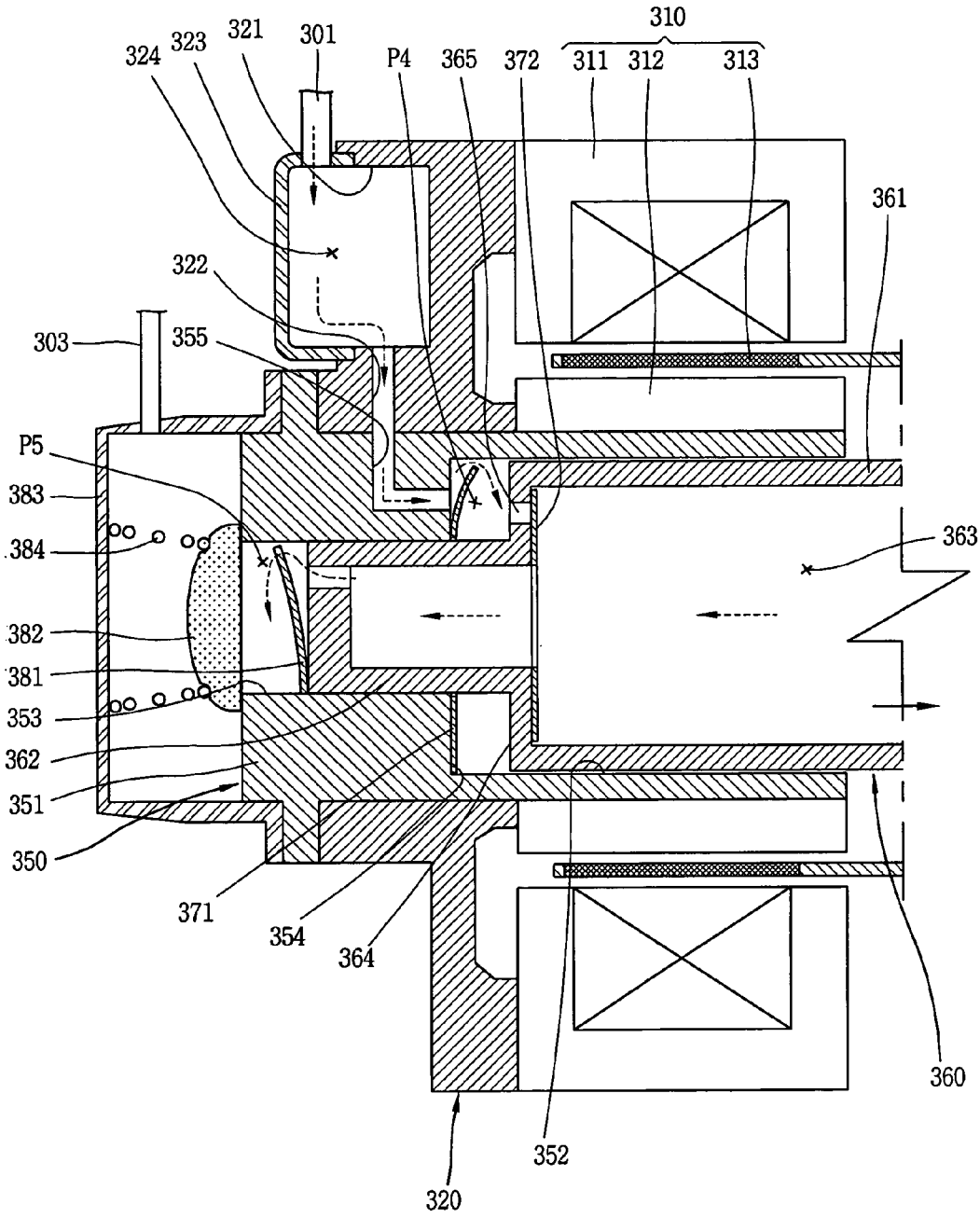
FIGS. 4 and 5 are sectional views respectively showing an operation state of the reciprocating compressor according to the present invention.

As shown in FIG. 4, when the two-stage piston 360 is moved towards the right side, pressures inside the first compression space P4 and the second compression space P5 are lowered and the first suction valve 371 and the second suction valve 381 are respectively opened. As the first suction valve 371 is opened, a refrigerant is sucked into the first compression space P4 having a low pressure through the first suction flow path. Also, as the second suction valve 381 is opened, the refrigerant introduced into the casing 300 through the second suction pipe 302 is sucked into the second compression space P5 having a low pressure through the gas passage 363.

Figure 5:
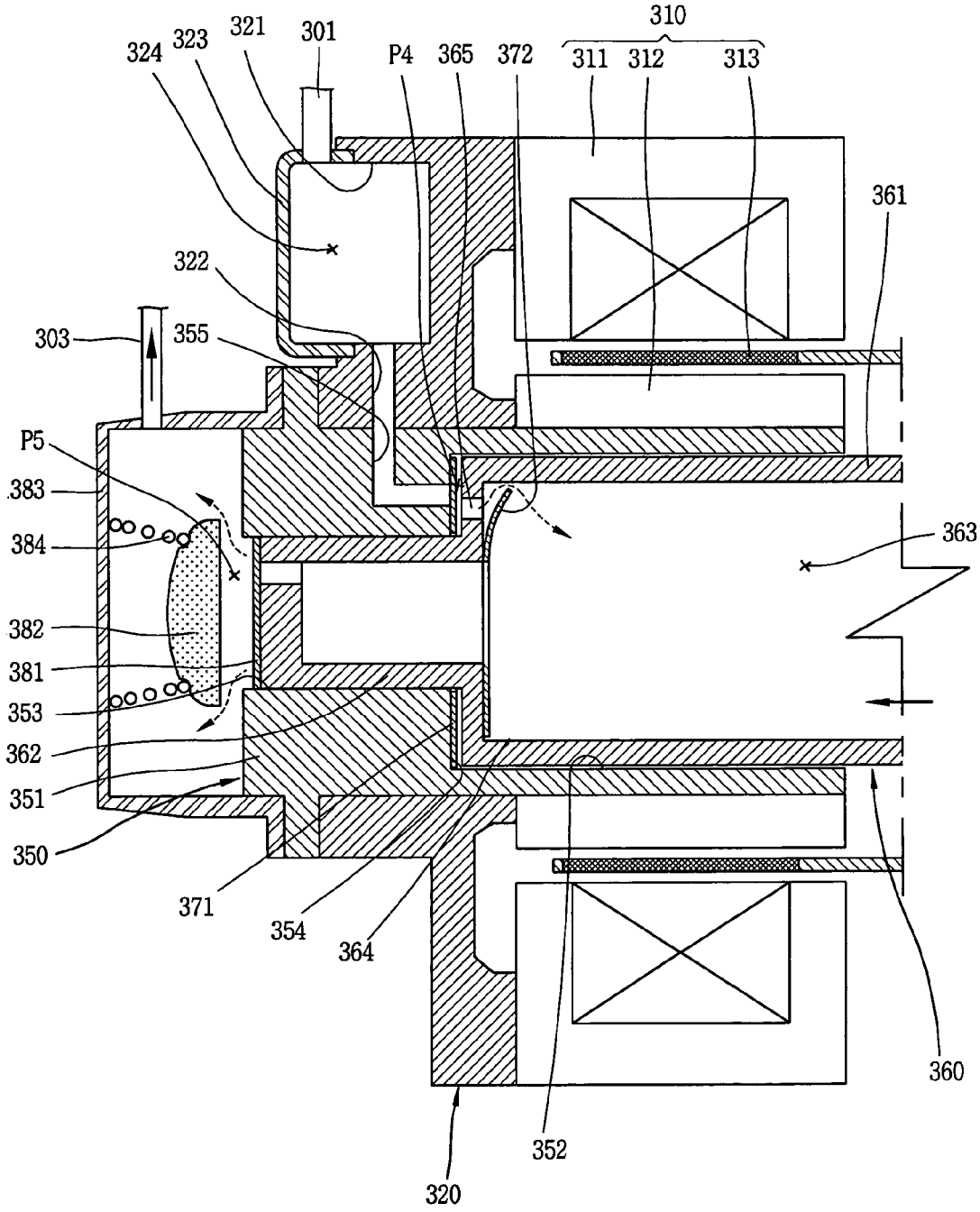

As shown in FIG. 5, when the two-stage piston 360 moves to the left side from the right side, the pressures inside the first compression space P4 and the second compression space P5 are increased. At the same time, the first suction valve 371 blocks the first suction flow path and the second suction valve 381 blocks the gas passage 363. When the two-stage piston 360 moves to the left side further, volumes of the first compression space P4 and the second compression space P5 are gradually decreased and the refrigerant is compressed. When a pressure of the refrigerant is more than a preset pressure, the first discharge valve 372 and the second discharge valve 382 are respectively opened and the refrigerant compressed in the first compression space P4 and the second compression space P5 are respectively discharged.

The refrigerant discharged from the first compression space P4 is discharged into the casing 300 through the discharge hole 365 and the gas passage 363, and the refrigerant discharged from the second compression space P5 is discharged outside the casing 300 through the discharge cover 383 and the discharge pipe 303.

The refrigerant compressed in the first compression space P4 and discharged into the casing 300 is mixed with the refrigerant sucked into the casing 300 through the second suction pipe 302, and then is sucked into the second compression space P5 through the gas passage 363 at the time of a suction stroke.

The refrigerant sucked into the second compression space P5 is the refrigerant compressed once in the first compression space P4, and the refrigerant compressed once is compressed in the second compression space P5 once more thereby to be discharged outside the casing 300.

The above processes are repeated thereby to two-stage compress the refrigerant continuously.

Figure 6:
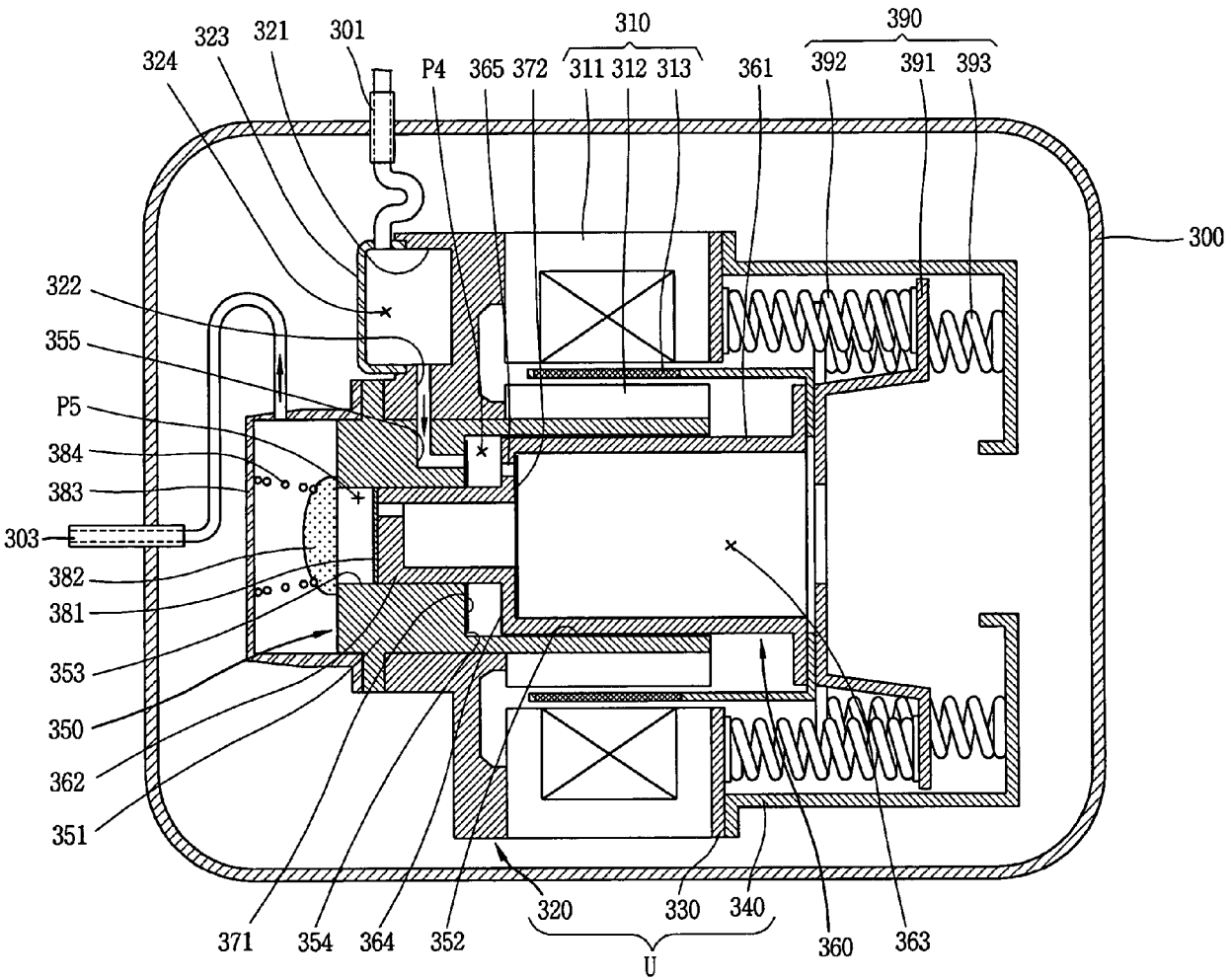
FIG. 6 is a sectional view showing a second embodiment of the reciprocating compressor according to the present invention.

FIG. 6 is a sectional view showing a second embodiment of the reciprocating compressor according to the present invention, in which the same reference numerals were given to the same parts as those of FIG. 3.

As shown, the reciprocating compressor according to the second embodiment comprises a casing 300, one reciprocating motor 310 mounted at a frame unit U provided inside the casing 300 for generating a linear-reciprocation driving force, a first compression unit for one-stage compressing a refrigerant directly sucked without passing through the inside of the casing 300 by receiving the driving force of the reciprocating motor 310, and a second compression unit for two-stage compressing the refrigerant one-stage compressed by the first compression unit by receiving the driving force of the reciprocating motor 310.

The frame unit U and the reciprocating motor 310 according to the second embodiment have the same constructions as those of the first embodiment. Accordingly their detailed explanations are omitted.

The first and second compression units respectively comprise a two-stage cylinder 350 having first and second cylinder holes 352 and 353 of different inner diameters consecutively formed with a step there between and mounted at the frame unit U, a two-stage piston 360 having a first piston portion 361 and a second piston portion 362 corresponding to the inner diameters of the first and second cylinder holes 352 and 353 and linearly-reciprocated in the two-stage cylinder 350 by receiving the driving force of the reciprocating motor 310, a first suction valve 371 for opening and closing a first suction flow path for directly guiding a refrigerant to be sucked into the first compression space P4 formed by the first piston portion 361 and the first cylinder hole 352 without passing through the inside of the casing 300, a first discharge valve 372 for controlling a flow of a refrigerant discharged from the first compression space P4, a second suction valve 381 for opening and closing the gas passage 363 for guiding the refrigerant discharged from the first compression space P4 to be sucked into the second compression space P5 formed by the second piston portion 362 and the second cylinder hole 353, and a second discharge valve 382 for controlling a flow of the refrigerant discharged from the second compression space P5.

The above construction according to the second embodiment is the same as that according to the first embodiment. Accordingly its detailed explanation is omitted.

The resonant spring unit 390 for causing a resonant motion of the two-stage piston 360 has the same construction as the resonant spring unit 390 of the first embodiment.

A suction pipe connected to the first suction flow path and the discharge pipe 303 connected to the discharge side are respectively coupled to the casing 300.

One end of the suction pipe is coupled to the cover 323 constituting the chamber 324 of the first suction flow path so that a refrigerant introduced into the suction pipe can be directly introduced into the first suction flow path.

Also, one end of the discharge pipe 303 is fixedly coupled to one side of the discharge cover 383 so that the discharge pipe 303 can be connected to inside of the discharge cover 383.

An operation of the reciprocating compressor according to the second embodiment will be explained as follows.

When a power is applied to the reciprocating motor 310, the mover 313 of the reciprocating motor 310 is linearly reciprocated and the linear-reciprocation of the mover 313 is transmitted to the two-stage piston 360 thereby to linearly-reciprocate the two-stage piston 360 in the two-stage cylinder 350.

As the two-stage piston 360 is linearly-reciprocated in the two-stage cylinder 350, volumes of the first compression space P4 and the second compression space P5 are simultaneously changed. As the result, a refrigerant is directly sucked into the first compression space P4 through the suction pipe 304 and the first suction flow path, compressed, and then is discharged into the casing 300. The refrigerant compressed once and discharged into the casing 300 is sucked into the second compression space P5 through the gas passage 363, and then is compressed once more. Then refrigerant compressed in the second compression space P5 once more is discharged outside the casing 300 through the discharge pipe 303.

The above processes are repeated thereby to two-stage compress the refrigerant continuously.

According to the reciprocating compressor of the second embodiment, one suction pipe 304 and one discharge pipe 303 are provided, so that a refrigerant sucked into the suction pipe 304 is sequentially compressed in the first compression space P4 and the second compression space P5 two times. Then, the refrigerant compressed two times is discharged outside the casing 300 through the discharge pipe 303.

Figure 7:
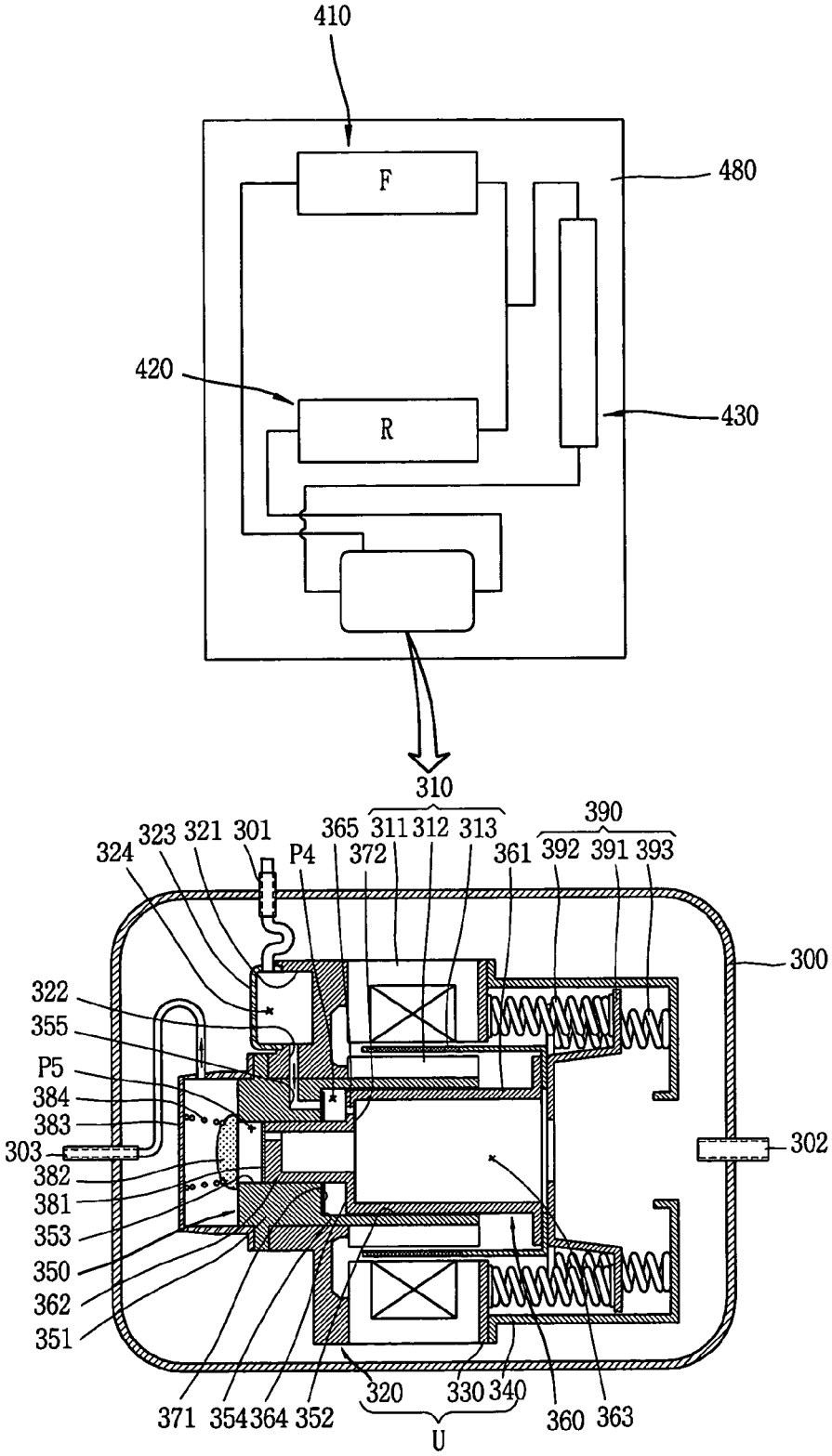
FIG. 7 is a sectional view showing a refrigerator having the reciprocating compressor according to the present invention.

As shown in FIG. 7, a refrigerator having the reciprocating compressor of the present invention comprises a body 400 provided with a freezing chamber and a refrigerating chamber, a freezing chamber side evaporator 410 and a refrigerating chamber side evaporator 420 mounted at the body 400, and the refrigerator connected to the freezing chamber side evaporator 410 and the refrigerating chamber side evaporator 420.

The reciprocating compressor comprises a casing 300 mounted at the body, one reciprocating motor 310 mounted at a frame unit U provided in the casing 300 for generating a linear-reciprocation driving force, a first compression unit for directly sucking a refrigerant that has passed through the freezing chamber side evaporator 410 and then compressing the refrigerant by receiving the driving force of the reciprocating motor 310, and a second compression unit for compressing a mixed refrigerant, which is a combination of a refrigerant introduced into the casing 300 via the refrigerating chamber side evaporator 420 and a refrigerant discharged from the first compression unit.

The reciprocating compressor of the second embodiment has the same construction as that of the first embodiment and can also be utilized in the refrigerator of FIG. 7. According detailed explanations are omitted.

A first suction pipe 301 of the reciprocating compressor is connected to the freezing chamber side evaporator 410, and a second suction pipe 302 of the reciprocating compressor is connected to the refrigerating chamber side evaporator 420.

Reference numeral 430 denotes a condenser.

An operation of the refrigerator having the reciprocating compressor of the present invention will be explained as follows.

When the refrigerator is operated, the reciprocating compressor is operated and thereby a refrigerant compressed in the reciprocating compressor is discharged to the condenser. The refrigerant that has passed through the condenser becomes a liquid state. A part of the liquid refrigerant is introduced into the freezing chamber side evaporator 410, and the rest thereof is introduced into the refrigerating chamber side evaporator 420. The refrigerant converted into a gaseous state via the freezing chamber side evaporator 410 is introduced into the second compression unit of the reciprocating compressor through the second suction pipe 302.

While the refrigerant is vaporized by the freezing chamber side evaporator 410, external heat is absorbed and thereby cool air is formed, and while the refrigerant is vaporized by the refrigerating chamber side evaporator 420, external heat is absorbed and thereby cool air is formed. The refrigerant that has passed through the freezing chamber side evaporator 410 has a lower pressure than the refrigerant that has passed through the refrigerating chamber side evaporator 420. Accordingly, the pressure of the refrigerant introduced into the first suction pipe 301 is relatively lower than the pressure of the refrigerant introduced into the second suction pipe 302.

The reciprocating compressor of the second embodiment is operated in the same manner as that of the first embodiment.

The refrigerant introduced into the first compression unit is compressed once, and then is discharged to the inside of the casing 300. The refrigerant discharged from the first compression unit is mixed with the refrigerant introduced into the casing 300 through the second suction pipe 302. The mixed refrigerant is compressed in the second compression unit and is discharged to the condenser 430.

While the above processes are repeated, cool air is continuously formed by the freezing chamber side evaporator 410 and the refrigerating chamber side evaporator 420.

In the refrigerator having the reciprocating compressor of the present invention, the refrigerant that has passed through the freezing chamber side evaporator 410 and having a relatively lower pressure is compressed once by the first compression unit. Then, the compressed refrigerant is mixed with the refrigerant that has passed through the refrigerating chamber side evaporator 420 and having a relatively higher pressure. The mixed refrigerant is compressed once more by the second compression unit, thereby reducing a load of the reciprocating compressor.

As aforementioned, the reciprocating compressor of the present invention consecutively compresses a refrigerant two times by using one reciprocating motor 310, one two-stage cylinder 350, and one two-stage piston 360, thereby simplifying components, facilitating a fabrication, reducing a fabrication cost, and enhancing a productivity.

Also, when the two-stage piston 360 moves in the two-stage cylinder 350 in one direction by receiving the driving force of the reciprocating motor 310, the refrigerant is simultaneously compressed in the first compression space P4 and the second compression space P5. Accordingly, the stroke of the two-stage piston 360 is controlled more easily and precisely thereby to enhance the compression efficiency.

Also, according to the refrigerator having the reciprocating compressor of the present invention, the refrigerant is consecutively compressed in the reciprocating compressor two times thereby to decrease the load of the reciprocating compressor. Accordingly, the efficiency of the reciprocating compressor is enhanced and the efficiency of the refrigerator is enhanced. Besides, since the fabrication cost of the reciprocating compressor is lowered and the productivity thereof is increased, the fabrication cost of the refrigerator is reduced.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

What is claimed is:

1. A reciprocating compressor comprising:

a casing;

a frame elastically supported in an inner space of the casing;

a reciprocating motor including an inner stator and an outer stator fixed on the frame, and a linearly-movable mover inserted between the inner stator and the outer stator;

a two-stage cylinder, mounted at the frame, having first and second cylinder bores of different diameters with a stepped surface therebetween;

a two-stage piston, having a first piston portion and a second piston portion having diameters corresponding to the diameters of the first and second cylinder bores, the first and second piston portions linearly-reciprocating in the same direction in the two-stage cylinder by the driving force of the reciprocating motor so as to simultaneously suck, compress and discharge refrigerant;

a resonant spring that causes the two-stage piston to move in a resonant motion;

a first suction valve and a first discharge valve, respectively disposed at an inlet and an outlet of a first compression space formed by the first piston portion and the first cylinder bore;

a second suction valve and a second discharge value, respectively disposed at an inlet and an outlet of a second compression space formed by the second piston portion and the second cylinder bore;

a first suction pipe that is connected at an inlet side of the first compression space and extends through the casing;

a second suction pipe that is connected at an inlet side of the second compression space and extends through the casing; and a discharge pipe that is connected at an outlet side of the second compression space and extends through the casing, wherein refrigerant is directly introduced into the first compression space through the first suction pipe, the refrigerant is compressed in the first compression space and discharged into the inner space of the casing, the compressed refrigerant is introduced into the second compressed space and mixed with other refrigerant which is directly introduced into the casing through the second suction pipe, and the mixed refrigerant in the second compression space is discharged outside of the casing through the discharge pipe.

2. The reciprocating compressor of claim 1, wherein the inlet side of the first compression space is provided with a chamber having a space in which liquid refrigerant is vaporized.

3. The reciprocating compressor of claim 2, wherein the chamber comprises:

an opening formed at one side of the frame; and a cover that covers the opening.

4. The reciprocating compressor of claim 1, wherein the stepped surface between the first cylinder bore and the second cylinder bore is perpendicular to axes of the first and second cylinder bores, and a stepped surface between the first piston portion and the second piston portion of the two-stage piston is perpendicular to axes of the first and second piston portions.

5. The reciprocating compressor of claim 1, wherein a first suction opening that connects the first suction pipe and the inlet side of the first compression space is formed in the frame; and a second suction opening that connects the first suction opening and the first compression space is formed in the two-stage cylinder.

6. The reciprocating compressor according to claim 1, wherein a gas passage for introducing refrigerant from the inner space of the casing into the second compression space is provided within the two-stage piston.

7. A compressor comprising:

a casing;

a drive mechanism that includes an inner stator and an outer stator, and a linearly-movable mover inserted between the inner stator and the outer stator so as to generate a linear reciprocation driving force;

a first chamber into which a refrigerant is introduced from outside the casing, the refrigerant being compressed within the first chamber by action of the drive mechanism and being discharged to a second chamber;

the second chamber, which receives the refrigerant compressed in the first chamber, and mixes the compressed refrigerant with additional refrigerant to provide a mixed refrigerant;

a third chamber into which the mixed refrigerant is introduced and is further compressed by action of the drive mechanism, the compressed mixed refrigerant being discharged to an exterior of the casing;

a first valve that opens and closes a flow path to guide refrigerant into the first chamber;

a second valve that controls a discharge of compressed refrigerant from the first chamber into the second chamber;

a third valve that controls a flow of mixed refrigerant from the second chamber to the third chamber; and a fourth valve that controls a flow of the compressed mixed refrigerant from the third chamber to outside of the casing, wherein the first, second and third chambers comprise a compression unit, said compression unit comprising a two-stage cylinder having first and second bores of different diameters and a two-stage piston having first and second piston portions having diameters corresponding to the diameters of the first and second bores, and the first and third chambers simultaneously open and close so that the refrigerant in the first chamber and the mixed refrigerant in the second chamber are sucked, compressed and discharged simultaneously.

8. The compressor according to claim 7, said second chamber comprising an interior space of the two-stage piston.

9. The compressor according to claim 7, said first and third chambers being provided in spaces defined by said two-stage cylinder and said two-stage piston.

10. A refrigerator having a body provided with a freezing compartment and a refrigerating compartment, a condenser, a freezing compartment evaporator and a refrigerating compartment evaporator mounted to the body, and a reciprocating compressor, the compressor comprising:

a casing;

a frame elastically supported in an inner space of the casing;

a reciprocating motor including an inner stator and an outer stator fixed on the frame, and a linearly-movable mover inserted between the inner stator and the outer stator;

a two-stage cylinder, mounted at the frame, having first and second cylinder bores of different diameters with a stepped surface therebetween;

a two-stage piston, having a first piston portion and a second piston portion having diameters corresponding to the diameters of the first and second cylinder bores, the first and second piston portions linearly-reciprocating in the same direction in the two-stage cylinder by the driving force of the reciprocating motor so as to simultaneously suck, compress and discharge refrigerant;

a resonant spring that causes the two-stage piston to move in a resonant motion;

a first suction valve and a first discharge valve, respectively disposed at an inlet and an outlet of a first compression space formed by the first piston portion and the first cylinder bore;

a second suction valve and a second discharge valve, respectively disposed at an inlet and an outlet of a second compression space formed by the second piston portion and the second cylinder bore;

a first suction pipe that connects the freezing compartment evaporator and the first compression space, and extends through the casing;

a second suction pipe that connects the refrigerating compartment evaporator and the inner space of the casing, and extends through the casing; and a discharge pipe that connects the outlet side of the second compression space and the condenser, wherein refrigerant is directly introduced into the first compression space from the freezing compartment evaporator through the first suction pipe, the refrigerant is compressed in the first compression space and discharged into the inner space of the casing, the compressed refrigerant is introduced into the second compression space and mixed with other refrigerant which is directly introduced into the casing through the second suction pipe, the mixed refrigerant in the second compression space is discharged outside of the condenser through the discharge pipe, and refrigerant introduced into the condenser is divided into the freezing compartment evaporator and the refrigerant compartment evaporator.

11. The refrigerator of claim 10, wherein a gas passage for introducing refrigerant from the inner space of the casing into the second compression space is provided within the two-stage piston.

12. The refrigerator of claim 10, wherein the inlet side of the first compression space is provided with a chamber having a space in which liquid refrigerant is vaporized.

13. The refrigerator of claim 12, wherein the chamber comprises:

an opening formed at one side of the frame; and a cover that covers the opening.

14. The refrigerator of claim 10, wherein the stepped surface between the first cylinder bore and the second cylinder bore is perpendicular to axes of the first and second cylinder bores, and a stepped surface between the first piston portion and the second piston portion of the two-stage piston is perpendicular to axes of the first and second piston portions.

15. The refrigerator of claim 10, wherein a first suction opening that connects the first suction pipe and the inlet side of the first compression space is formed in the frame; and a second suction opening that connects the first suction opening and the first compression space is formed in the two-stage cylinder.

* * * * *